US006314744B1

(12) United States Patent
Ogawa

(10) Patent No.: US 6,314,744 B1
(45) Date of Patent: Nov. 13, 2001

(54) AIR-CONDITIONING SYSTEM AND OPERATION CONTROL METHOD THEREOF

(75) Inventor: Masahiro Ogawa, Aichi-ken (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/296,627

(22) Filed: Apr. 23, 1999

(30) Foreign Application Priority Data

May 1, 1998 (JP) ..... 10-122354

(51) Int. Cl.[7] ..... F25B 7/00; F25B 17/00
(52) U.S. Cl. ..... 62/79; 62/106; 62/333
(58) Field of Search ..... 62/79, 106, 144, 62/333

(56) References Cited

U.S. PATENT DOCUMENTS 4,439,994 * 4/1984 Briley ..... 62/335 X
5,018,367 * 5/1991 Yamada et al. ..... 62/335 X
5,402,653 * 4/1995 Yanadori ..... 62/333

FOREIGN PATENT DOCUMENTS 5-272832 10/1993 (JP) .
5-296598 11/1993 (JP) .
5-296599 11/1993 (JP) .
6-94967 11/1994 (JP) .

* cited by examiner

*Primary Examiner*—William Wayner
(74) *Attorney, Agent, or Firm*—Oblon, Spivak, McClelland, Maier & Neustadt, P.C.

(57) ABSTRACT

A hybrid air-conditioner comprises a vapor adsorption cycle air-conditioner, a vapor compression refrigerating cycle air-conditioner, an external heat source circuit and the like. In the case where the external heat source temperature is in a high temperature range, the cooling operation is performed using only the vapor adsorption cycle air-conditioner. In the case where the external heat source temperature is in a low temperature range, the cooling operation is performed using only the vapor compression refrigerating cycle air-conditioner. In the case where the external heat source temperature is in an intermediate temperature range, the cooling operation is performed using both the vapor adsorption cycle air-conditioner and the vapor compression refrigerating cycle air-conditioner. As a result, the temperature restrictions on the vapor adsorption cycle air-conditioner can be removed and the range of operation allowance can be widened.

12 Claims, 8 Drawing Sheets

AIR-CONDITIONING SYSTEM AND OPERATION CONTROL METHOD THEREOF

BACKGROUND OF THE INVENTION

1. Field of the Invention

The present invention relates to an air-conditioning system and a method of controlling the operation thereof.

2. Description of the Related Art

A vapor compression refrigerating cycle air-conditioner has been widely used as a conventional air-conditioning system. A vapor adsorption cycle air-conditioner is also known as another type of air-conditioning system. An example of the vapor adsorption cycle air-conditioner is disclosed in Japanese Patent Application Laid-Open (JP-A) No.5-272832.

In spite of its advantage that other thermal energy can be introduced in the process of regenerating the adsorbent, this type of vapor adsorption cycle air-conditioner has various problems pointed out. An especially serious problem posed when using the vapor absorption cycle air-conditioner is that the vapor adsorption cycle air-conditioner itself fails to operate unless the adsorbent is kept in a predetermined temperature environment. In other words, the operation of the vapor adsorption cycle air-conditioner always requires temperature restrictions for the adsorbent. This is one of the stumbling blocks to the extension of the use of the vapor adsorption cycle air-conditioner.

SUMMARY OF THE INVENTION

In view of the aforementioned fact, the object of the present invention is to provide an air-conditioning system and an operation control method thereof, in which the temperature restrictions for operating the vapor adsorption cycle air-conditioner or the vapor-absorption cycle air-conditioner are removed and the tolerable operation range of the vapor adsorption cycle air-conditioner or the vapor absorption cycle air-conditioner can be widened.

According to a first aspect of the present invention, there is provided an air-conditioning system comprising:

a vapor adsorption cycle air-conditioner constituting an adsorption refrigerating cycle provided with an evaporator, a condenser and a plurality of adsorption tanks or a vapor absorption cycle air-conditioner constituting an absorption refrigerating cycle provided with an evaporator, a condenser, an absorber and a regenerator;

a vapor compression refrigerating cycle air-conditioner connected to the adsorption tank of the vapor adsorption cycle air-conditioner or to the absorber and the regenerator of the vapor absorption cycle air-conditioner for heating or cooling the adsorbent or the absorbing solution as required; and external heat source means connected to the adsorption tank of the vapor adsorption cycle air-conditioner or to the absorber and the regenerator of the vapor absorption cycle air-conditioner for heating or cooling the adsorbent or the absorption solution using a heating medium supplied from the external heat source as required.

According to a second aspect of the invention, there is provided an air-conditioning system comprising a vapor adsorption cycle air-conditioner used in the first aspect, wherein the adsorption tank on the adsorption side and the adsorption tank on the regeneration side are connected to each other by a dedicated heat recovery circuit for recovering heat by circulating a dedicated heat recovery heating medium between the two tanks.

According to a third aspect of the invention, there is provided a method of controlling the operation of the air-conditioning system in the first or second aspect, comprising the steps of:

operating in cooling mode using only the vapor adsorption cycle air-conditioner or the vapor absorption cycle air-conditioner in the case where the external heat source temperature of the heating medium supplied from an external heat source means is in a predetermined high temperature range;

operating in cooling mode using only the vapor compression refrigerating cycle air-conditioner in the case where the external heat source temperature of the heating medium supplied from the external heat source means is in a predetermined low temperature range; and operating in cooling mode using both the vapor adsorption cycle air-conditioner and the vapor compression refrigerating cycle air-conditioner at the same time or both the vapor absorption cycle air-conditioner and the vapor compression refrigerating cycle air-conditioner at the same time in the case where the external heat source temperature of the heating medium supplied from the external heat source means is in a predetermined intermediate temperature range.

According to a fourth aspect of the invention, there is provided a method of controlling the operation of an air-conditioning system in the third aspect of the invention, wherein in the case where the external heat source temperature of the heating medium supplied from the external heat source means is in a predetermined intermediate temperature range, the high-temperature heating medium of the vapor compression refrigerating cycle air-conditioner is used for heating the adsorbent in the adsorption tank on regeneration side or the absorption solution in the regenerator.

According to a fifth aspect of the invention, there is provided a method of controlling the operation of an air-conditioning system in the third or fourth aspect, wherein for fast cooling operation, both the vapor adsorption cycle air-conditioner and the vapor compression refrigerating cycle air-conditioner are used at the same time or both the vapor absorption cycle air-conditioner and the vapor compression refrigerating cycle air-conditioner are used at the same time.

According to a sixth aspect of the invention, there is provided a method of controlling the operation of an air-conditioning system in the first or second aspect, wherein for fast heating operation, both the vapor adsorption cycle air-conditioner and the vapor compression refrigerating cycle air-conditioner are used at the same time or both the vapor absorption cycle air conditioner and the vapor compression refrigerating cycle air-conditioner are used at the same time.

The operation according to the first aspect of the invention is as described below. This case involves a vapor adsorption cycle air-conditioner.

In the vapor adsorption cycle air-conditioner, the process of adsorbing the vapor by dry adsorbent in a adsorption tank is normally conducted in parallel with the process of removing the vapor from a saturated adsorbent in a adsorption tank, so that the two adsorption tanks are used alternately and repeatedly.

More specifically, vapor from the evaporator is adsorbed by the dry adsorbent in a adsorption tank, whereby the latent heat of vaporization for cooling the heating medium in the evaporator is taken away. With the progress of adsorption of the vapor by the adsorbent, the adsorbent temperature increases to such a degree as to make vapor adsorption difficult. It is then necessary to cool the adsorbent. The saturated adsorbent in a tank, on the other hand, is heated and deprived of vapor and sent into the condenser. In other words, the adsorbent is required to be dried (regenerated). For this purpose, the adsorbent is cooled in the former case and heated in the latter case by the external heat source means. In this way, the adsorption and the regeneration are alternated to maintain the refrigerating cycle.

The vapor adsorption cycle air-conditioner having the above-described configuration generally fails to operate unless the adsorption temperature and the regeneration temperature of the adsorbent meet predetermined temperature conditions. In the case where the external heat source temperature of the external heat source means is sufficiently high, for example, the vapor adsorption cycle air-conditioner operates properly. In the case where the external heat source temperature of the external heat source means lowers, however, the proper operation of the vapor adsorption cycle air-conditioner cannot be assured by simple use of the external heat source means without taking any measure.

As the measure to be taken as described above, according to this invention, the adsorption tank of the vapor adsorption cycle air-conditioner and the vapor compression refrigerating cycle air-conditioner are connected to each other. The temperature of the adsorbent can thus be regulated by cooling the adsorbent in the adsorption tank on adsorption side or heating the adsorbent in the adsorption tank on regeneration side. In other words, the adsorbent temperature regulation, if insufficient, by the external heat source means is made up for by the vapor compression refrigerating cycle air-conditioner, thereby making it possible to secure the proper operation of the vapor adsorption cycle air-conditioner.

According to the second aspect of the invention using the vapor adsorption cycle air-conditioner, the adsorption tank on adsorption side and the adsorption tank on regeneration side are interconnected by a dedicated heat recovery circuit for recovering heat by circulating a dedicated heat recovery medium between the two tanks. Thus, the following operation can be performed.

Prior to switching between the adsorption process and the regeneration process, the heating medium is returned to the external heat source from the adsorption tank on adsorption side and the adsorption tank on regeneration side. As a result, the heat loss of the heating medium of the external heat source can be prevented. Then, the dedicated heat recovery heating medium is circulated between the adsorption tank on adsorption side and the adsorption tank on regeneration side using a dedicated heat recovery circuit. At the time point when the temperature of the adsorption tank on adsorption side comes to equal the temperature of the adsorption tank on regeneration side as far as possible, the dedicated heat recovery heating medium is pooled in the dedicated heat recovery circuit. By doing so, the heat loss of the heating medium of the external heat source can be avoided while at the same time making it possible to recover heat from the adsorption tank on adsorption side and the adsorption tank on regeneration side. The heat thus recovered can be used for preheating or precooling of the adsorption tanks.

According to the third aspect of the invention, in the case where the external heat source temperature of the heating medium supplied from the external heat source means is in a high-temperature range, the vapor adsorption cycle air-conditioner or the vapor absorption cycle air-conditioner alone can secure a sufficient operation, and therefore the cooling operation is performed using only the vapor adsorption cycle air-conditioner or the vapor absorption cycle air-conditioner.

In the case where the external heat source temperature of the heating medium supplied from the external heat source means is in a predetermined low temperature range, on the other hand, the vapor adsorption cycle air-conditioner or the vapor absorption cycle air-conditioner fails to operate. Therefore, the cooling operation is performed using only the vapor compression refrigerating cycle air-conditioner having a high efficiency itself.

In the case where the external heat source temperature of the heating medium supplied from the external heat source means is in a predetermined intermediate temperature range, both the vapor adsorption cycle air-conditioner and the vapor compression refrigerating cycle air-conditioner are used or both the vapor absorption cycle air-conditioner and the vapor compression refrigerating cycle air-conditioner are used for performing the cooling operation. Specifically, the shortage of the heat supplied from the heating medium from the external heat source means is supplemented by the heating or cooling operation of the vapor compression refrigerating cycle air-conditioner. As a result, it is possible to secure the proper operation of the vapor adsorption cycle air-conditioner or the vapor absorption cycle air-conditioner in the intermediate temperature range.

Especially when the regeneration temperature falls or the adsorption (absorption) temperature rises in the intermediate temperature range, the efficiency of the vapor adsorption cycle air-conditioner or the vapor absorption cycle air-conditioner is liable to be adversely affected. According to this invention, however, a high efficiency can be secured in the intermediate temperature range by using the vapor compression refrigerating cycle air-conditioner with a narrow temperature drop.

According to the fourth aspect of the invention, in the case where the heat source temperature of the heating medium supplied from the external heat source means is in a predetermined intermediate temperature range, the high-temperature heating medium of the vapor compression refrigerating cycle air-conditioner is used for heating the adsorbent in the adsorption tank on regeneration side or the absorption solution in the regenerator. Thus, the shortage of the external heat source temperature can be supplemented by the heat of the vapor compression refrigerating cycle air-conditioner.

According to the fifth aspect of the invention, when the system operates in fast cooling operation, both the vapor adsorption cycle air-conditioner and the vapor compression refrigerating cycle air-conditioner are used at the same time or both the vapor absorption cycle air-conditioner and the vapor compression refrigerating cycle air-conditioner are used at the same time. As compared with the case in which only one of the air-conditioners of either couple is used, the initial cooling rate is doubled or increased more.

According to the sixth aspect of the invention, in the case where the system operates in fast heating operation, both the vapor adsorption cycle air-conditioner and the vapor compression refrigerating cycle air-conditioner are used at the same time or both the vapor absorption cycle air-conditioner and the vapor compression refrigerating cycle air-conditioner are used at the same time. As compared with when only one of the air-conditioners of either couple is used, the initial heating rate can be doubled or increased more.

DESCRIPTION OF THE PREFERRED EMBODIMENTS

The hybrid air-conditioner 10 constituting an air-conditioning system according to the present invention will now be explained with reference to FIGS. 1 to 3.

Figure 1:
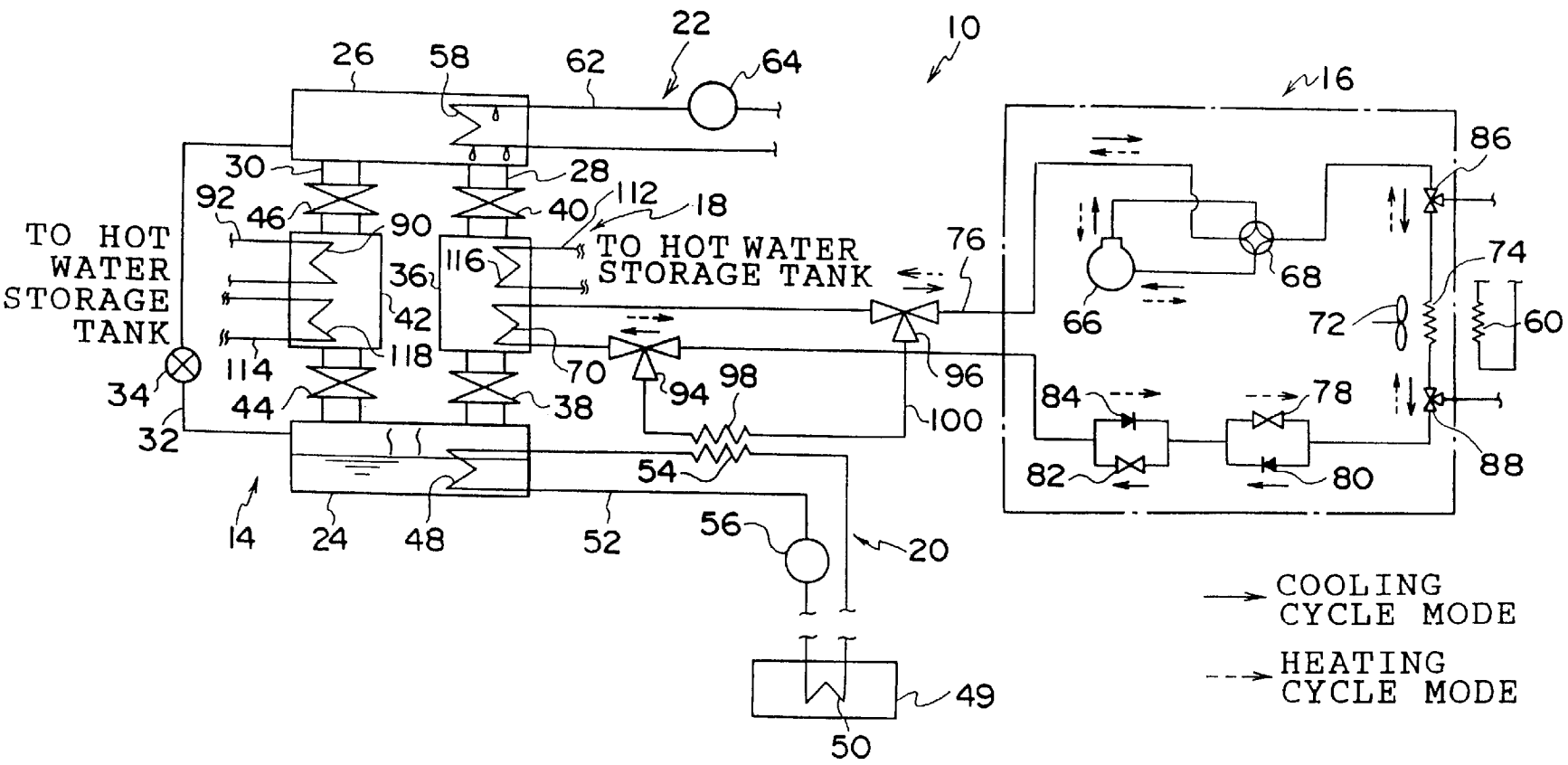
FIG. 1 is a diagram showing a general configuration built around a vapor adsorption cycle air-conditioner and a vapor compression refrigerating cycle air-conditioner of a hybrid air-conditioner according to the present embodiment.

FIG. 1 schematically shows a configuration of the hybrid air-conditioner 10 according to the present embodiment. FIG. 2 shows a general configuration of a hot water storage tank 12 built into the hybrid air-conditioner 10. As shown in these diagrams, the hybrid air-conditioner 10 generally comprises a vapor adsorption cycle air-conditioner 14, a vapor compression refrigerating cycle air-conditioner 16, an external heat source circuit 18, an indoor brine circuit 20, and a condenser cooling brine circuit 22. of all these component parts, the vapor adsorption cycle air-conditioner 14, the vapor compression refrigeration cycle air-conditioner 16 and the external heat source circuit 18 constitute the essential parts of the hybrid air-conditioner 10 according to the present embodiment.

[Configuration of Vapor Adsorption Cycle Air-conditioner 14]

As shown in FIG. 1, the vapor adsorption cycle air-conditioner 14 includes an evaporator 24 and a condenser 26. The evaporator 24 and the condenser 26 are connected (communicated) to each other by a first connecting tube 28 and a second connecting tube 30. Further, the evaporator 24 and the condenser 26 are interconnected (communicated) by the return tube path 32. A flow rate regulation valve 34 is provided in the middle of the return tube path 32.

A first adsorption tank 36 accommodating an adsorbent such as silicagel is provided midway on the first connecting tube 28. Also, a first switching valve 38 is provided between the first adsorption tank 36 and the evaporator 24, and a second switching valve 40 is interposed between the first adsorption tank 36 and the condenser 26 in the first connecting tube 28.

In similar fashion, a second adsorption tank 42 containing an adsorbent such as silicagel is provided midway on the second connecting tube 30. Also, a third switching valve 44 is provided between the second adsorption tank 42 and the evaporator 24, and a fourth switching valve 46 is interposed between the second adsorption tank 42 and the condenser 26 in the second connecting tube 30.

The evaporator 24 described above is connected to an indoor brine circuit 20. The indoor brine circuit 20 includes a first heat exchanger 48 passing through the evaporator 24, a second heat exchanger 50 connected to an indoor unit 49, a brine tube path 52 connecting the first heat exchanger 48 and the second heat exchanger 50, a third heat exchanger 54 provided midway on the brine tube path 52, and a water pump 56 provided midway on the brine tube path 52 for supplying the brine.

Further, the condenser 26 described above is connected to a condenser cooling brine circuit 22. The condenser cooling brine circuit 22 includes a first heat exchanger 58 passing through the condenser 26, a second heat exchanger 60 juxtaposed with the second heat exchanger 74 of the vapor compression refrigerating cycle air-conditioner 16 which will be explained later, a cooling medium tube path 62 connecting the first heat exchanger 58 and the second heat exchanger 60, and a water pump 64 provided midway on the cooling medium tube path 62 for supplying the cooling medium.

[Configuration of Vapor Compression Refrigerating Cycle Air-conditioner 16]

The vapor compression refrigerating cycle air-conditioner 16, on the other hand, has a three-coil heat pump circuit configuration. Specifically, it includes a compressor 66 for sending a heating medium such as fleon under pressure, a four-way valve 68 for changing the heating medium supply cycle, a first heat exchanger 70 connected to the first adsorption tank 36, a second heat exchanger 74 juxtaposed with a fan 72, a heat pump side cooling medium tube path 76 for connecting the elements described above, and a first expansion valve 78 with a first check valve 80 and a second expansion valve 82 with a second check valve 84, arranged in series between the first heat exchanger 70 and the second heat exchanger 74 in the heat pump side cooling medium tube path 76.

Also, a first three-way valve 86 and a second three-way valve 88 are provided on oppsite sides of the second heat exchanger 74 of the heat pump side cooling medium tube path 76. The first three-way valve 86 and the second three-way valve 88 are connected to another heat pump side cooling medium tube path 92 for leading the heating medium to the third heat exchanger 90 provided in the second adsorption tank 42.

Further, a third three-way valve 94 and a fourth three-way valve 96 are provided at the inlet and the outlet of the first heat exchanger 70 in the heat pump side cooling medium tube path 76. The third three-way valve 94 and the fourth three-way valve 96 are connected to a bypass tube path 100 for leading the heating medium to the fourth heat exchanger 98 for exchanging heat with the third heat exchanger 54 of the indoor brine circuit 20 described above.

[Configuration of External Heat Source Circuit 18]

Figure 2:
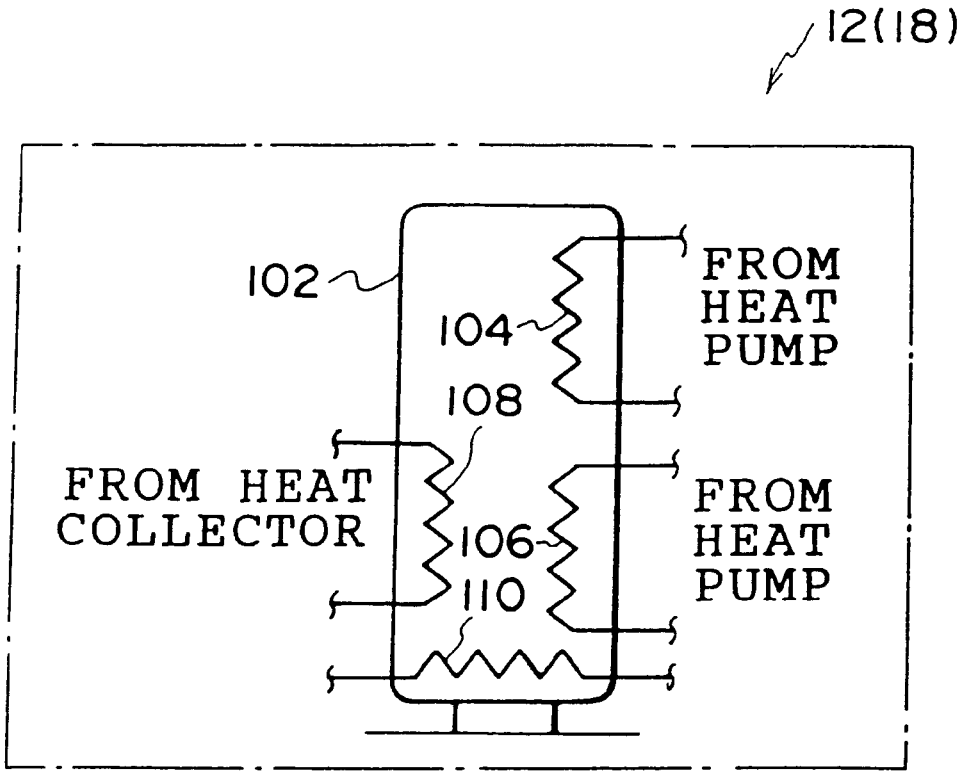
FIG. 2 is a diagram showing a general configuration of the hot water storage tank of the external heat source circuit built into the hybrid air-conditioner according to the present embodiment.

The hybrid air-conditioner 10 described above has built therein the external heat source circuit 18 shown in FIG. 2. The external heat source circuit 18 includes a hot water storage tank 12 as an essential part. The hot water storage tank 12 includes a hot water storage tank unit 102, a first heat exchanger 104 provided on the upper outer periphery of the hot water storage tank unit 102, a second heat exchanger 106 provided on the lower outer periphery of the hot water storage tank unit 102, a third heat exchanger 108 provided on the same axis but with a different diameter from the second heat exchanger 106 on the lower outer periphery of the hot water storage tank 102, and an electric heater 110 provided on the bottom of the hot water storage tank 102.

The first heat exchanger 104 and the second heat exchanger 106 are connected to the vapor compression refrigerating cycle air-conditioner 16 described above and operatively interlocked (for a heat exchanging operation) with the vapor compression refrigerating cycle air-conditioner 16. Also, the third heat exchanger 108 is connected with a heat collector utilizing a solar system not shown, and operatively interlocked (for a heat exchanging operation) with the heat collector.

The hot water tank 12 described above is connected to the indoor brine circuit 20 and to the first tubepath 112 for the external heat source and the second tube path 114 for the external heat source on the other. The first tube path 112 for the external tube path is for supplying the external heat source water to the first heat exchanger 116 provided in the first adsorption tank 36. The second tube path 114 for the external heat source is for supplying the external heat source water to the second heat exchanger 118 provided in the second adsorption tank 42.

Further, although not shown, the hot water tank 12 has a water supply hole in the lower outer wall of the hot water storage tank 102 a high temperature water outlet in the central portion of the lid of the hot water storage tank 102, and a further return water inlet in the lower outer wall of the hot water storage tank 102.

The operation of the hybrid air-conditioner 10 described above is controlled by a controller not shown. The controller is connected with a temperature sensor or the like on the input side thereof for detecting various temperatures including the external heat source temperature of the external heat source circuit 18 and the indoor temperature used as data for determining the operation mode. Also, in order to operate the hybrid air-conditioner 10 in the selected mode based on the detected temperatures, the output side of the controller is connected to all the valves including the first switching valve 38 to the fourth switching valve 46, all the drive means including the compressor 66 and water pumps 56 and 64 constituting the drive sources for supplying a heating medium, and all the auxiliary equipment including a fan 72.

Now, the operation and effects of the present embodiment will be explained.

[Cooling Operation]

<<When the External Heat Source Temperature T(114) is High, i.e. When 80° C.<T(114)>>

In this case, only the vapor adsorption cycle air-conditioner 14 is used but not the vapor compression refrigerating cycle air-conditioner 16. In other words, in the case where the external heat source temperature T(114) is sufficiently high, the heat energy held by the external heat source circuit 18 is sufficient to activate the vapor adsorption cycle air-conditioner 14 appropriately.

Specifically, the first switching valve 38 and the fourth switching valve 46 of the vapor adsorption cycle air-conditioner 14 are opened while the second switching valve 40 and the third switching valve 44 are closed by a controller. Also, the flow rate regulation valve 34 is opened. At this time point, it is assumed that the adsorbent of the first adsorption tank 36 is dry and the adsorbent of the second adsorption tank 42 is saturated.

Under the circuit condition described above, the adsorbent in the first adsorption tank 36 is dry. Therefore, the vapor is generated in the evaporator 24 by the difference in humidity between the interior of the first adsorption tank 36 and the interior of the evaporator 24. The vapor generated in the evaporator 24 enters the first adsorption tank 36 by way of the first switching valve 38 and is adsorbed to the adsorbent in the first adsorption tank 36.

At the same time, i.e. when the vapor is generated in the evaporator 24, the latent heat of vaporization is taken away so that the evaporator 24 decreases in temperature. The evaporator 24 is connected with the first heat exchanger 48 of the indoor brine circuit 20. By driving the water pump 56, therefore, the heating medium (brine) is cooled by heat exchange while passing through the first heat exchanger 48. The heating medium thus cooled is supplied to the second heat exchanger 50, so that the cool air is supplied indoors through the indoor unit 49 from the second heat exchanger 50.

With the progress of adsorption of vapor to the adsorbent in the first adsorption tank 36, the temperature of the particular adsorbent increases. With the increase in the adsorbent temperature, the adsorption performance of the adsorbent normally decreases. The adsorbent therefore is required to be cooled. In the case where the adsorbent of the first adsorption tank 36 has sufficiently adsorbed the vapor and become saturated, the second adsorption tank 42 constituting a pair with the first adsorption tank 36 is prepared in place of the latter. Specifically, the saturated adsorbent in the second adsorption tank 42 paired with the first adsorption tank 36 is dried (regenerated).

Figure 7:
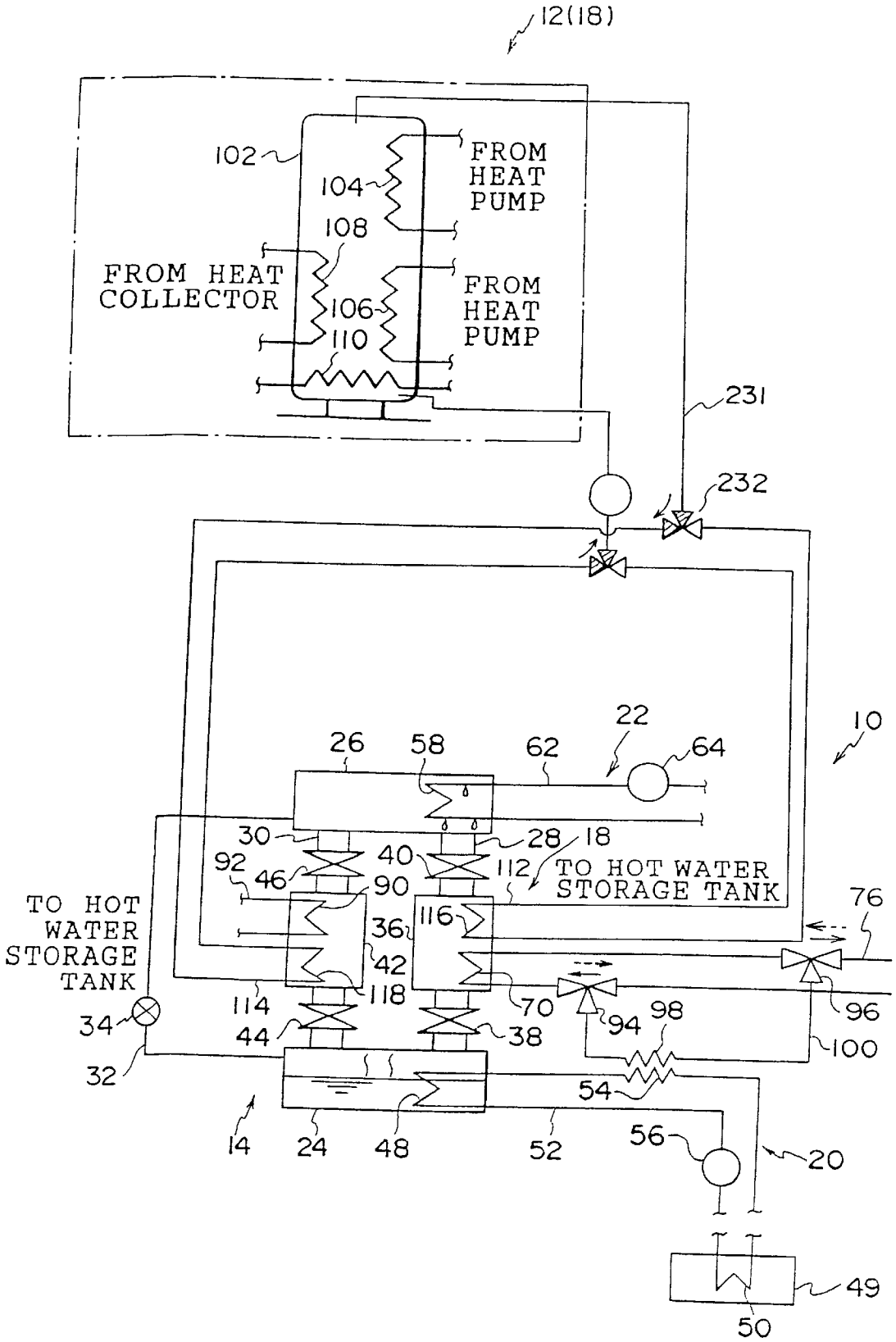
FIG. 7 is a diagram showing a connection between the hot water storage tank and the vapor adsorption cycle air-conditioner.

More specifically, the air-cooled heating medium (cool water) is supplied to the first heat exchanger 116 connected to the first adsorption tank 36 through the first tube path 112 for the external heat source. At the same time, the high-temperature heating medium (hot water) is supplied to the second heat exchanger 118 connected to the second adsorption tank 42 through a tube path 231, a three way valve 232 (FIG. 7) and the second tube path 114 for the external heat source from the hot water storage tank 12 of the external heat source circuit 18.

When the heating medium is supplied to the second heat exchanger 118, the saturated adsorbent in the second adsorption tank 42 is heated until it reaches a dry state (the vapor thus far adsorbed to the adsorbent is removed). As a result, the second adsorption tank 42 becomes ready for use (is regenerated). The vapor generated in the process enters the condenser 26 through the fourth switching valve 46. The condenser 26 is connected to the first heat exchanger 58 of the condenser cooling brine circuit 22. By driving the water pump 64, the heating medium air-cooled by the second heat exchanger 60 is supplied to the first heat exchanger 58 and exchanges heat with the influent vapor and liquefies the latter. The liquefied heating medium is returned to the evaporator 24 through the return tube path 32 and the flow rate regulation valve 34.

In this way, the first adsorption tank 36 and the second adsorption tank 42 are alternately used to perform the cooling operation of the vapor adsorption cycle air-conditioner 14.

<<When the External Heat Source Temperature T(114) is in a High Intermediate Temperature Range, i.e. When 50° C.<T(114)≦80° C.>>

The vapor adsorption cycle air-conditioner 14 operates only at predetermined adsorption temperatures and predetermined regeneration temperatures. With the decrease of the external heat source temperature T(114), therefore, the proper operation cannot be secured only with the heat obtained from the external heat source circuit 18. In view of this, according to the present embodiment, in these temperature ranges, the cooling operation is performed using both the vapor adsorption cycle air-conditioner 14 and the vapor compression refrigerating cycle air-conditioner 16 under the control of a controller. In other words, the shortage of the heat obtained from the external heat source circuit 18 is supplemented by the heat obtained from the vapor compression refrigerating cycle air-conditioner 16.

To explain further, in order to assure a smooth refrigerating cycle of the vapor adsorption cycle air-conditioner 14, smooth vapor adsorption and removal to and from the adsorbent is required to be repeated. For this purpose, formula 1 below must be satisfied in a state of equilibrium.

Vapor pressure in evaporator 24/vapor pressure in first adsorption tank 36>Vapor pressure in condenser 26/vapor pressure in second adsorption tank 42 (1)

This formula 1 indicates that unless the adsorbent is sufficiently dry at high temperatures, the adsorbent cannot sufficiently adsorb the vapor at low temperatures.

Also, formula 1can be expressed with an equilibrium vapor pressure (vapor pressure at the temperatures of the respective parts) by formula 2 below.

$$P_{T(24)}/P_{T(36)}>P_{T(26)}/P_{T(42)} \quad (2)$$

where $P_{T(24)}$ is the equilibrium vapor pressure in the evaporator 24, $P_{T(36)}$ the equilibrium vapor pressure in the first adsorption tank 36, $P_{T(26)}$ the equilibrium vapor pressure in the condenser 26, and $P_{T(42)}$ the equilibrium vapor pressure in the second adsorption tank 42.

T(24) is predetermined as 5° C. to 10° C. in the cooling operation and regarded as a constant in this range. In the aforementioned case in which the external heat source temperature T(114) substantially equal to T(42) is sufficiently high, the right side of equation 2 is sufficiently small. Therefore, the vapor adsorption cycle air-conditioner 14 operates without fail. In the case where the external heat source temperature T(114) lowers to about the intermediate temperature range, however, it is necessary to reduce T(26) and T(36) accordingly. For this purpose, the vapor compression refrigeration cycle air-conditioner 16 is also used.

Specifically, the vapor adsorption cycle air-conditioner 14 is set by a controller in the same mode as in the high temperature ranges described above. On the other hand, the vapor compression refrigerating cycle air-conditioner 16 is set in the cooling cycle mode (the refrigerant cycle mode indicated by solid arrow in FIG. 1).

When the compressor 66 and the fan 72 are activated under the circuit condition described above, the high-temperature high-pressure heating medium such as fleon is supplied through a four-way valve 68 to the second heat exchanger 74, where it is condensed by exchanging heat with the atmosphere (in this case, it follows that the second heat exchanger 74 acts as a condenser). The heating medium thus condensed is decreased in pressure as it passes through the first check valve 80 and the second expansion valve 82 in that order. The heating medium thus decreased in pressure is passed through the third three-way valve 94, afterwhich it is supplied to the first heat exchanger 70, where it exchanges heat with the adsorbent in the first adsorption tank 36 and is evaporated. As a result, the adsorbent in the first adsorption tank 36 is cooled. The heating medium thus cooled is passed through the fourth three-way valve 96 and returned to the compressor 66 through the four-way valve 68.

Figure 8:
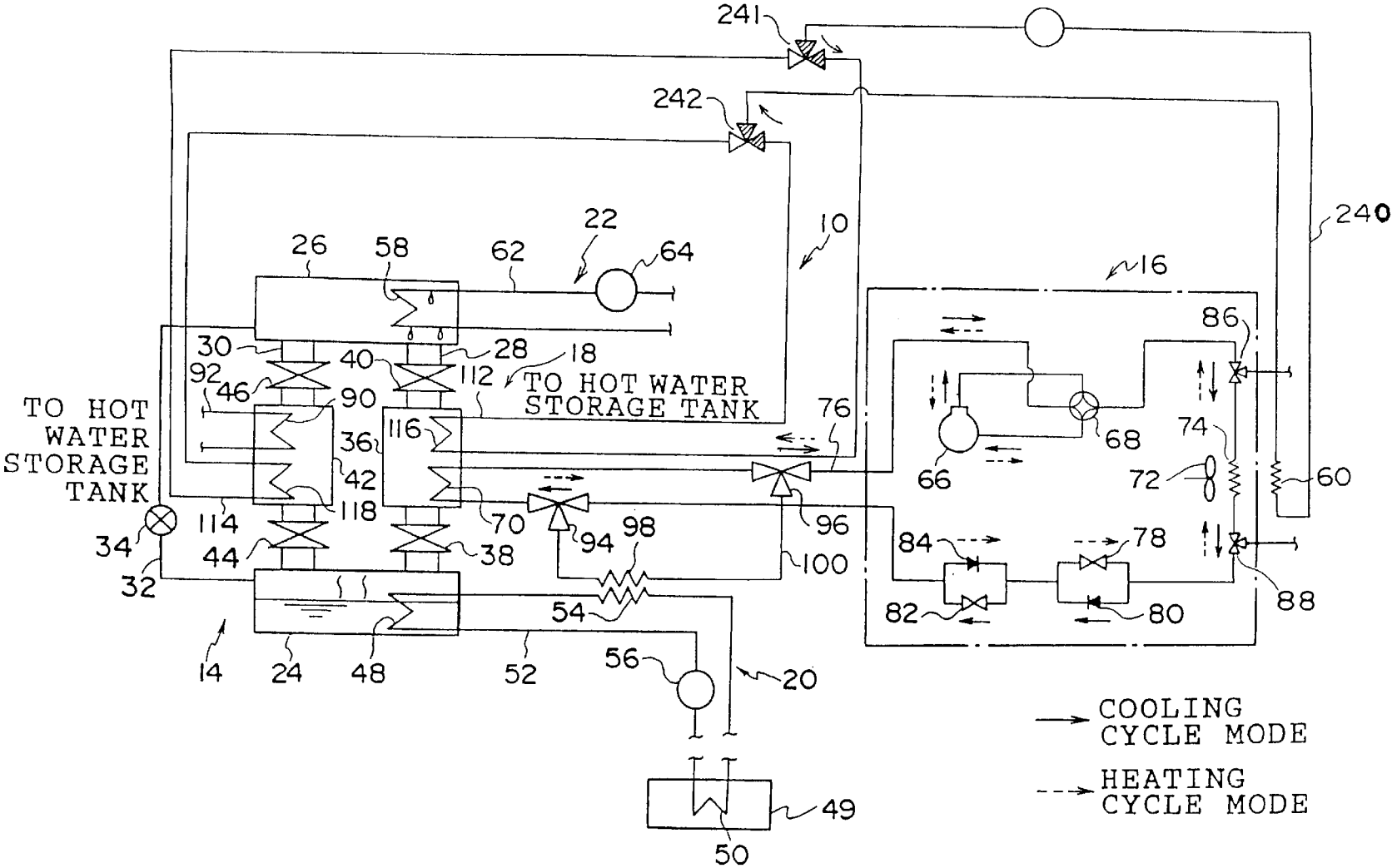
FIG. 8 is a diagram showing a connection between the vapor adsorption cycle air-conditioner and a vapor compression refrigerating cycle air-conditioner.

To explain further, as described above, the vapor compression refrigerating cycle air-conditioner 16 operates as a supplementary means. At the same time as this operation, the heating medium (cool water) cooled by heat exchange with the atmosphere in the fan 72 and the second heat exchanger 60 is circulated in the first heat exchanger 116 by the controller. FIG. 8 shows the first heat exchanger 116 is connected to the second heat exchanger 60 through a tube pipe 240, and three way valves 241 and 242. In other words, the vapor compression refrigerating cycle air-conditioner 16 does the work equivalent to the difference between the atmospheric temperature and T(26), T(36).

In the case where the external heat source temperature T(114) is in a high intermediate temperature range, the combined use of the vapor adsorption cycle air-conditioner 14 and the vapor compression refrigerating cycle air-conditioner 16 produces the following result in terms of efficiency.

Assume that T(26)=T(36). In the case where T(114) and T(36) substantially equal to T(42) are changed, the COP of the whole system is approximately calculated as shown in Table 1 below.

TABLE 1

| T(114)/T(36) [° C.] | COP |
|---|---|
| | COP = ∞ |
| 80/40 | . . . |
| 70/35 | COP = 9 |
| 60/30 | . . . |
| 50/25 | COP = 6 |
| 40/20 | . . . |
| | COP = 3 |

In Table 1, the heat energy of the external heat source circuit 18 is not taken into account. This is by reason of the fact that the heat energy taken as solar energy from the solar system is inexhaustible and free of cost and therefore need not be included in the COP calculation.

In the case where an ordinary vapor compression refrigerating cycle air-conditioner 16 is used in cooling cycle mode, the evaporation temperature is 5° C. and the condensation temperature is 50° C. (heat drop=45° C.) so that COP is about 3. According to the present embodiment, however, as seen from Table 1 shown above, T(36) can be 25° C. (heat drop=25° C.) when T(114)=50° C., so that CP is about 6. In this way, the efficiency is doubled very advantageously.

According to the present embodiment, the first heat exchanger 70 and the first heat exchanger 116 are juxtaposed in the first adsorption tank 36, and the third heat exchanger 90 and the second heat exchanger 118 are juxtaposed in the second adsorption tank 42. In other words, the adsorbent is cooled by two systems. In place of this configuration, a structure may be employed where the first adsorption tank 36 is cooled only with the first heat exchanger 116 for the external heat source circuit 18, and the second adsorption tank 42 is cooled only with the second heat exchanger 118, i.e. the adsorbent is cooled by a single system with the heating medium (cool water) precooled using the vapor compression refrigerating cycle air-conditioner 16.

<<When the External Heat Source Temperature T(114) is in a Low Intermediate Temperature Range, i.e. When 30° C.<T(114)≦50° C. >>

In this case, too, the vapor adsorption cycle air-conditioner 14 is used in combination with the vapor compression refrigerating cycle air-conditioner 16 in the same manner as in the preceding case where the external heat source temperature T(114) is in the high intermediate temperature range. Since the external heat source temperature T(114) is still lower than in the preceding case, however, the heat held by the high-temperature heating medium of the vapor compression refrigerating cycle air-conditioner 16 is additionally used to secure the high external heat source temperature T(114).

Specifically, the vapor compression refrigerating cycle air-conditioner 16 is kept in cooling cycle mode by the controller, while the first three-way valve 86 and the second three-way valve 88 are closed and the compressor 66 is activated. As a result, the high-temperature high-pressure heating medium that has passed through the compressor 66 is sent as it is to the third heat exchanger 90 connected to the second adsorption tank 42 through the first three-way valve 86 and the second three-way valve 88 (but not through the second heat exchanger 74) whose direction of flow is changed and further through another refrigerant tube path 92 for the heat pump. Thus, the adsorbent in the second adsorption tank 42 is heated by two systems. Even in the case where the external heat source temperature T(114) is in the low intermediate temperature range, the regeneration temperature of the adsorbent in the second adsorption tank 42 is prevented from decreasing excessively for a lower efficiency. In other words, the shortage of the external heat source temperature T(114) is supplemented by the heat of the vapor compression refrigerating cycle air-conditioner 16.

<<When the External Heat Temperature T(114) is in a Low Temperature Range, i.e. When T(114)≦30° C.>>

In this case, the external heat source temperature T(114) is too low and therefore the vapor adsorption cycle air-conditioner 14 is not suitable. Therefore, only the vapor compression refrigerating cycle air-conditioner 16 high in efficiency is used.

Specifically, while the vapor compression refrigerating cycle air-conditioner 16 is kept in cooling cycle mode by the controller, the third three-way valve 94 and the fourth three-way valve 96 are closed. Under this condition, the compressor 66 and the fan 72 are activated. Upon activation of the compressor 66, the high-temperature high-pressure heating medium is sent through the four-way valve 68 to the second heat exchanger 40, where it exchanges heat with the atmospheric air. The condensed heating medium is decreased in pressure as it passes through the first check valve 80 and the second expansion valve 82 in that order. The flow path of the heating medium thus reduced in pressure is changed by the third three-way valve 94 and the heating medium sent into the bypass tube 100. This heating medium, after exchanging heat with the third heat exchanger 54 of the indoor brine circuit 20, has the flow path thereof changed again in the fourth three-way valve 96 and is returned to the compressor 66.

As a result of heat exchange between the fourth heat exchanger 98 and the third heat exchanger 54, cool air is sent indoors through the second heat exchanger 50. In this case, COP is about 3 as in the normal vapor compression refrigerating cycle air-conditioner 16.

To explain further, although the COP of the whole system is approximately calculated as T(26)=T(36) above, the relation strictly is T(26)>T(36). In this case, the approximately calculated COP and the temperature range deviate slightly.

<<Fast Cool Down>>

In this case, the vapor adsorption cycle air-conditioner 14 and the vapor compression refrigerating cycle air-conditioner 16 are used at the same time for the cooling operation.

Specifically, in FIG. 1, the vapor adsorption cycle air-conditioner 14 is operated as it is. Thus, the vapor from the evaporator 24 is adsorbed by the adsorbent of the first adsorption tank 36 thereby lowering the temperature of the evaporator 24. As the water pump 56 is driven, the heating medium flowing in the brine tube 52 of the indoor brine circuit 20 is cooled.

As to the vapor compression refrigerating cycle air-conditioner 16, on the other hand, the third three-way valve 94 and the fourth three-way valve 96 are closed by the controller, and the air-conditioner 16 is set in such a mode that the heating medium (refrigerant) flows in the bypass tube 100. When the compressor 66 and the fan 72 are activated under this circuit condition, the high-temperature high-pressure heating medium from the compressor 66 is condensed by the second heat exchanger 74 after passing through the four-way valve 68. The heating medium thus condensed passes through the first check valve 80 and the second expansion valve 82 in that order and decreases in pressure. After that, the heating medium enters the bypass tube path 100 by way of the third three-way valve 94 and is evaporated in the fourth heat-exchanger 98. The fourth heat exchanger 98 exchanges heat with the third heat exchanger 54 of the indoor brine circuit 20 thereby to further cool the heating medium flowing in the brine tube 52. As a result, the fast cool-down is realized at a double speed initial rate.

For faster cool-down, assume that the adsorbent of the first adsorption tank 36 and the adsorbent of the second adsorption tank 42 are both dry (i.e. in the initial stage of operation). Not only the first switching valve 38 but also the third switching valve 44 are opened while the second switching valve 40 and the fourth switching valve 46 are closed. Thus, the evaporator 24 is further cooled. This operation mode permits a fast cool-down at a triple speed initial rate.

[Heating Operation and Hot Water Supply]

In a heating operation, the vapor adsorption cycle air-conditioner 14 is not used basically for its low COP, but the vapor compression refrigerating cycle air-conditioner 16 is used when there is a narrow temperature drop where a high efficiency is obtained in relation to the external heat source circuit 18. In a heating operation, the external heat source circuit 18 is connected to the indoor brine circuit 20 by the controller, so that heat exchange becomes possible between the second heat exchanger 50 of the indoor brine circuit 20 and the hot water storage tank 12 of the external heat source circuit 18.

The description that follows refers to the case where the objective is to acquire hot water of 60° C. for a heating operation or for hot water supply mainly in winter.

<<When the Temperature T(108) of Hot Water Supplied From Heat Collector to Third Heat Exchanger 108 of Hot Water Tank 12 is in a High Temperature Range, i.e. When 60° C.<T(108)>>

In the case where the hot water temperature T(108) from the heat collector is higher than 60° C. as described above, the temperature of the water in the hot water storage tank 12 is also increased to about 60° C. by the third heat exchanger 108 of the hot water storage tank 12. Initially, therefore, this high-temperature water is directly supplied from the hot water storage tank 12 to the indoor brine circuit 20 so that the heat is radiated by the second heat exchanger 50 of the indoor brine circuit 20 thereby to supply a hot air.

At this time, a sufficient hot water temperature is secured, and therefore the hot water in the hot water storage tank 12 need not be increased in temperature by use of the vapor compression refrigerating cycle air-conditioner 16. However, since the hot water returned from the second heat exchanger 50 of the indoor brine circuit 20 to the hot water storage tank 12 is decreased to about 45° C. in temperature, it is heated by the method described below. In the process, an insulating partition is desirably formed in the hot water storage tank 102 or the hot water storage tank 102 is desirably constructed with a two-tank structure in order that the hot water heated to about 60° C. by the hot water supplied from the heat collector to the third heat exchanger 108 may not mix with the hot water returned from the second heat exchanger 50 which is decreased to 45° C. in temperature.

<<When the Temperature T(108) of Hot Water Supplied From the Heat Collector to the Third Heat Exchanger 108 of the Hot Water Storage Tank 12 is in an Intermediate Temperature Range, i.e. When T(108) is about 45° C.>>

In this case, the hot water temperature T(108) obtained by heat exchange with the third heat exchanger 108 is lower than a required temperature (60° C.), and therefore the vapor compression refrigerating cycle air-conditioner 16 is activated to increase the temperature.

Figure 5:
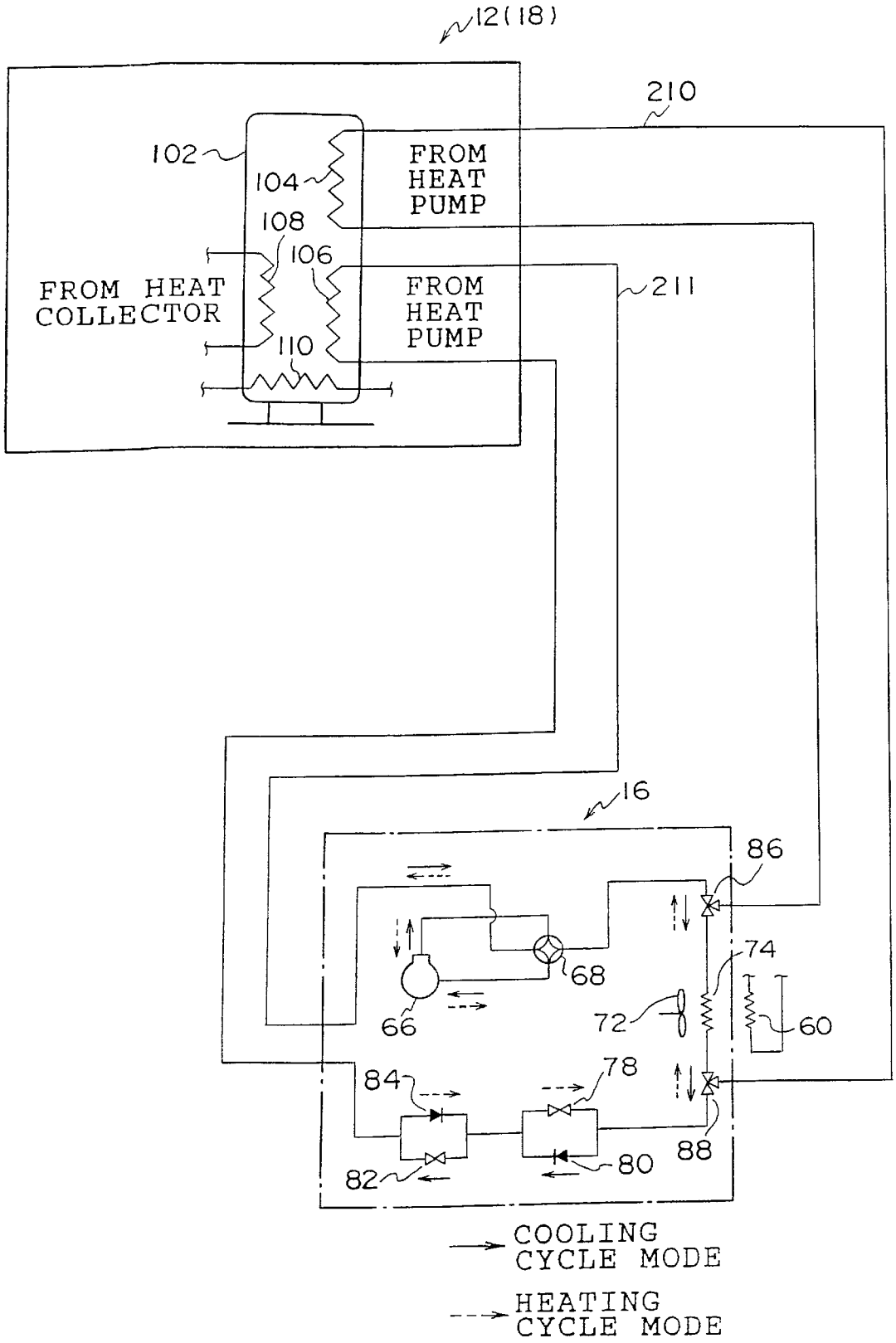
FIG. 5 is a diagram showing a connection between the hot water storage tank and the vapor compression refrigerating cycle air-conditioner.

Specifically, the vapor compression refrigerating cycle air-conditioner 16 used according to the present embodiment is of a three coil type. Therefore, the flow path is switched by the controller so that the vapor compression refrigerating cycle air-conditioner 16 shown in FIG. 1 is connected to the first heat exchanger 104 and the second heat exchanger 106 of the hot water storage tank 12. In FIG. 5, it is shown that the first and second heat exchangers 104 and 106 are connected to the vapor compression refrigerating cycle air-conditioner 16 via tube pipes 210 and 211. Under this circuit condition, the compressor 66 is driven. Next, the heat exchange operation of the first heat exchanger 104 and the second heat exchanger 106 produces the hot water of 60° C. from the heat exchanger 104 in the hot water storage tank 102. On the other hand, hot water which has decreased in temperature to 30° C. and which is present in substantially the same amount as the 60° C. hot water is produced by the second heat exchanger 106 in the hot water storage tank 102. This hot water is heated by the method described below. The heat drop between the 60° C. hot water and the 30° C. hot water is as small as 30° C., and therefore the efficiency of the vapor compression refrigerating cycle air-conditioner 16 is high.

<<When the Temperature T(108) of Hot Water Supplied From the Heat Collector to the Third Heat Exchanger 108 of the Hot Water Storage Tank 12 is in a low Temperature Range, i.e. When T(108) is about 30° C.>>

In this case, the hot water temperature T(108) obtained by heat exchange of the third heat exchanger 108 is still lower than the required temperature of 60° C., and therefore the vapor compression refrigerating cycle air-conditioner 16 is activated to increase the temperature using mid-night low-cost power.

Figure 6:
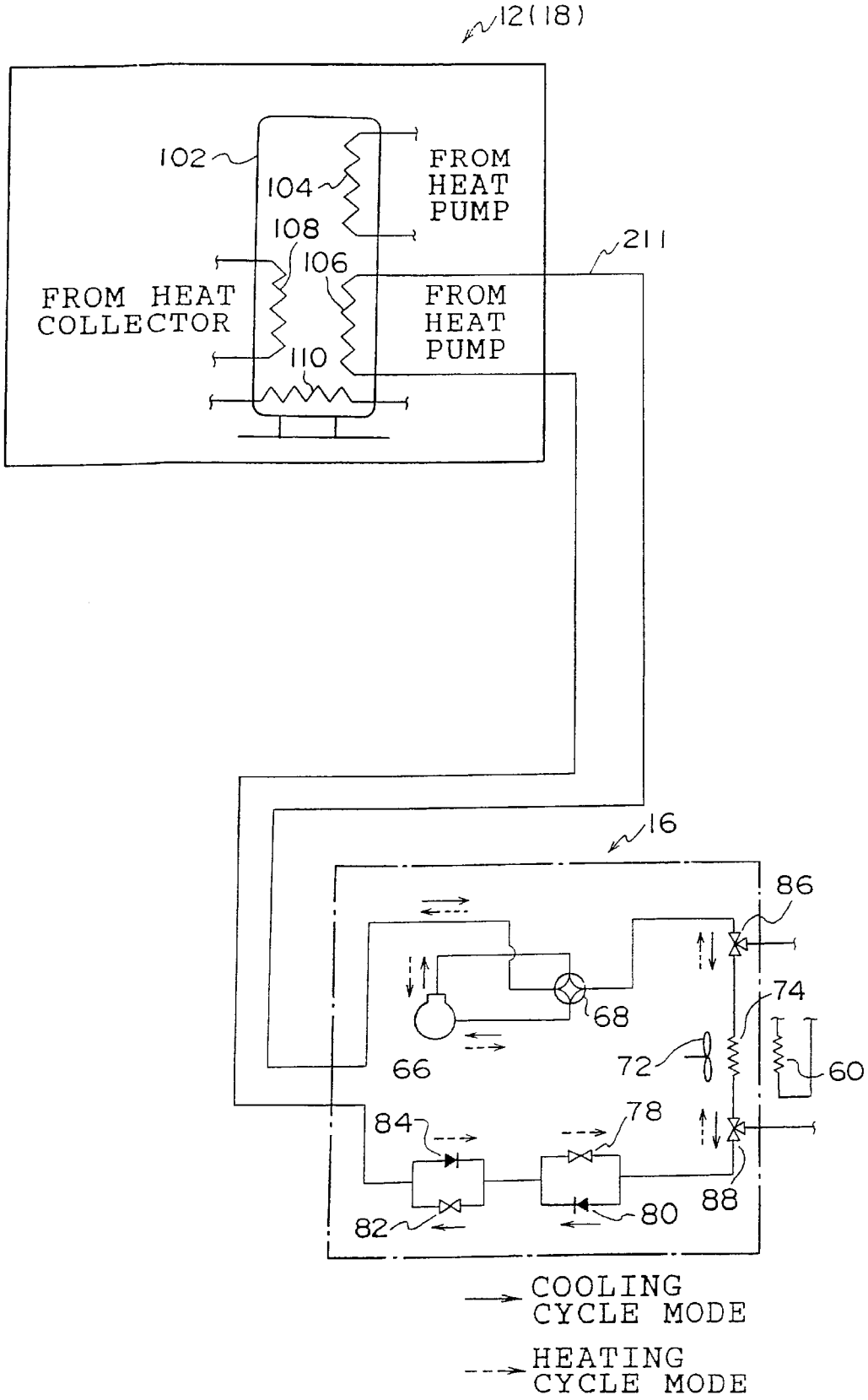
FIG. 6 is a diagram showing a connection between the hot water storage tank and the vapor compression refrigerating cycle air-conditioner.

Specifically, the flow path is switched by the controller so that the vapor compression refrigerating cycle air-conditioner 16 is connected with the second heat exchanger 106 of the hot water storage tank 12 through the tube pipe 211 (See FIG. 6). Under this circuit condition, the compressor 66 and the fan 72 are activated to exchange heat between the second heat exchanger 16 of the hot water storage tank 12 and the second heat exchanger 74 of the vapor compression refrigerating cycle air-conditioner 16. In other words, the atmospheric air (the atmospheric temperature 0° C. to 30° C.) is deprived of heat using the fan 72 and the second heat exchanger 74 of the vapor compression refrigerating cycle air-conditioner 16, and this heat is radiated through the second heat exchanger 106 of the hot water storage tank 12. As a result, the warm water of 30° C. is increased to 45° C. in temperature. After that, the warm water of 45° C. is increased to 60° C.

In the process, the maximum heat drop is 45° C., and the efficiency of the vapor compression refrigerating cycle air-conditioner 16 may be lower than when the hot water temperature T(108) is in the intermediate temperature range. For improving the efficiency in such a case, it is desirable to implement further measures such as, for example, adding a circuit for exchanging heat with the home waste hot water.

The evaporation pressure of the heating medium of the vapor compression refrigerating cycle air-conditioner 16 is considerably different between the hot water temperature T(108) in the intermediate temperature range and the hot water temperature T(108) in the low temperature range. Thus, the operating conditions (current, frequency, etc.) are optimized by the controller before actual operation.

Figure 4:
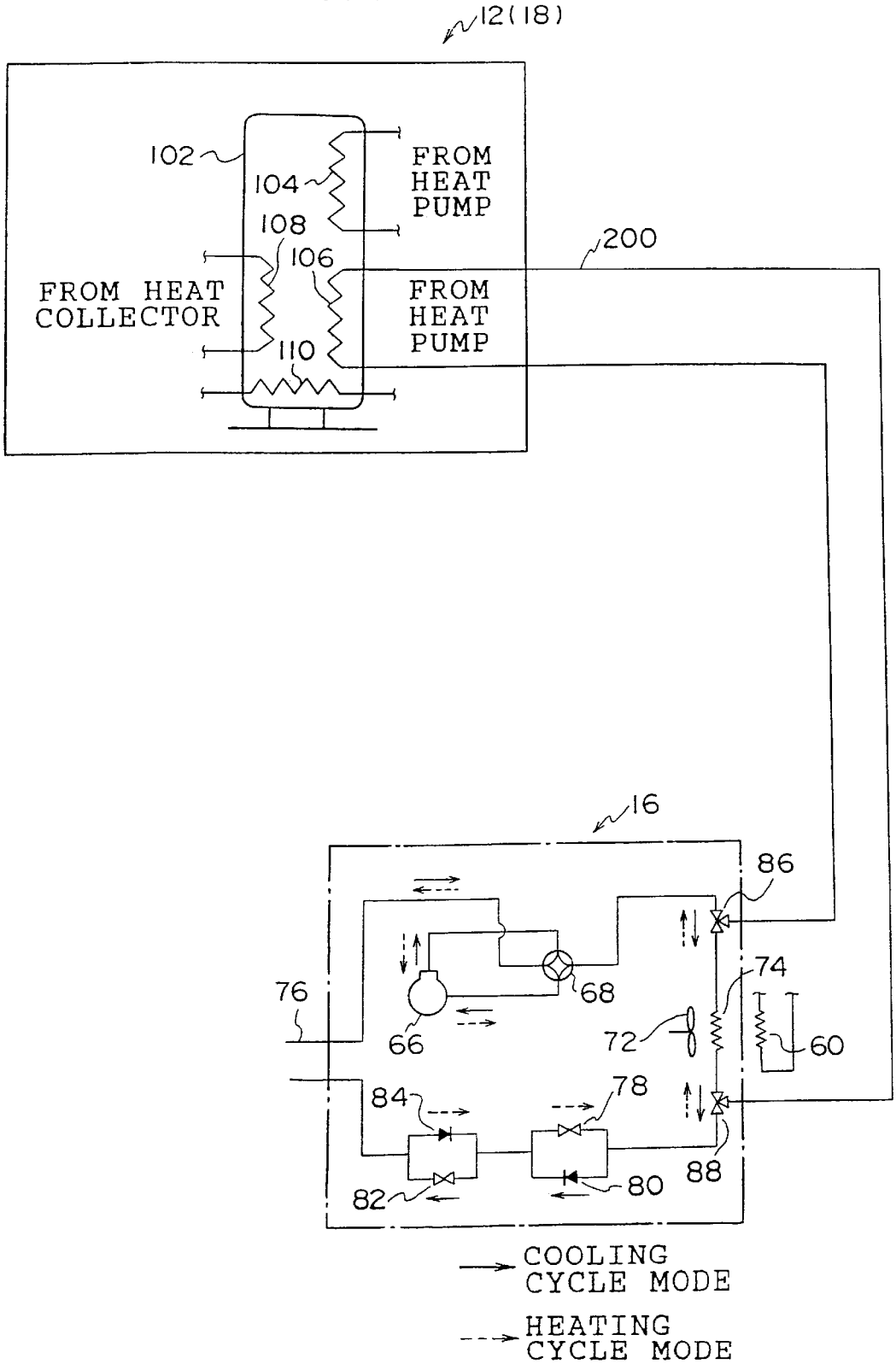
FIG. 4 is a diagram showing a connection between the hot water storage tank and the vapor compression refrigerating cycle air-conditioner.

The heating operation in the temperature range of 30° C.≦T(108)≦60° C. is required for supplying hot water even in summer. In such a case, therefore, the exhaust heat of the cooling operation is utilized (in cooling mode, the first three-way valve 86 and the second three-way valve 88 are switched thereby to use the first heat exchanger 104 or the second heat exchanger 106 instead of the second heat exchanger 74). In FIG. 4, it is shown a case that the second heat exchanger 106, which is connected by a tube pipe 200, is used for saving energy.

In this case, the water is as cool as lower than 5° C. and is not hot water from which heat can be acquired. Thus, the electric heater 110 of the hot water storage tank 12 is activated to heat the water directly to about 30° C. After that, as in the aforementioned case where the hot water temperature T(108) in low temperature range, the temperature is increased sequentially.

<<Fast Heat Up>>

In this case, the heating operation is performed in a combination of the vapor adsorption cycle air-conditioner 14 and the vapor compression refrigerating cycle air-conditioner 16.

Basically, this is similar to the aforementioned case of fast cool down. Specifically, in FIG. 1, the vapor adsorption cycle air-conditioner 14 is operated in the same manner as before except that the setting of the evaporation temperature of the evaporator 14 is raised. Thus, the heat radiated from the cooling medium tube path 62 connected to the condenser 26 and the heat radiated from the fourth heat exchanger 98 upon activation of the vapor compression refrigerating cycle air-conditioner 16 in heating cycle mode circumventing through the bypass tube 100, are introduced into the indoor brine circuit 20. As a result, the fast heat up is made possible at a double initial rate.

As a still faster heat up method, assume that the adsorbent of the first adsorption tank 36 and the adsorbent of the second adsorption tank 42 are both saturated. Not only the fourth switching valve 46 but the second switching valve 40 are opened while the first switching valve 38 and the third switching valve 44 are closed thereby to heat the condenser 26 further. This operation mode can realize a fast heat up at a triple-speed initial rate.

As described above, the present embodiment has a circuit configuration in which the vapor adsorption cycle air-conditioner 14 is combined with the external heat source circuit 18 and the vapor compression refrigerating cycle air-conditioner 16. In the case where the external heat source temperature T(114) is in high temperature range, the cooling operation is performed using only the vapor adsorption cycle air-conditioner 14. In the case where the external heat source temperature T(114) is in low temperature range, on the other hand, the cooling operation is performed using only the vapor compression refrigerating cycle air-conditioner 16 which itself has a high efficiency. In the case where the external heat source temperature T(114) is in an intermediate temperature range, the cooling operation is performed using both the vapor adsorption cycle air-conditioner 14 and the vapor compression refrigerating cycle air-conditioner 16. In this way, the temperature restriction is removed for activating the vapor adsorption cycle air-conditioner 14. As a consequence, the operation allowance of the vapor adsorption cycle air-conditioner 14 is widened, thus opening the way for multipurpose applications.

Especially, the combined operation of the vapor adsorption cycle air-conditioner 14 and the vapor compression refrigerating cycle air-conditioner 16 in an intermediate temperature range can achieve a higher efficiency than ever before.

Also, the use of the heat collector using the solar system as an external heat source of the external heat source circuit 18 makes inexhaustible heat energy available and has an energy-saving effect.

Further, according to the present embodiment, in the case where the external heat source temperature T(114) is in a low intermediate temperature range, the heat held in the high-temperature heating medium of the vapor compression refrigerating cycle air-conditioner 16 is utilized for heating the adsorbent of the second adsorption tank 42, and therefore the shortage of the external heat source temperature T(114) can be supplemented. As a result, according to the present embodiment, the stable operation of the vapor adsorption cycle air-conditioner 14 can be secured while at the same time improving the thermal efficiency.

Also, according to the present embodiment, the combined use of the vapor adsorption cycle air-conditioner 14 and the vapor compression refrigerating cycle air-conditioner 16 makes possible the fast cool down and the fast heat up at an initial rate twice or three times higher than before. As a result, the present embodiment not only improves the cooling/heating efficiency remarkably but also meets the needs of the users at the same time.

Figure 3:
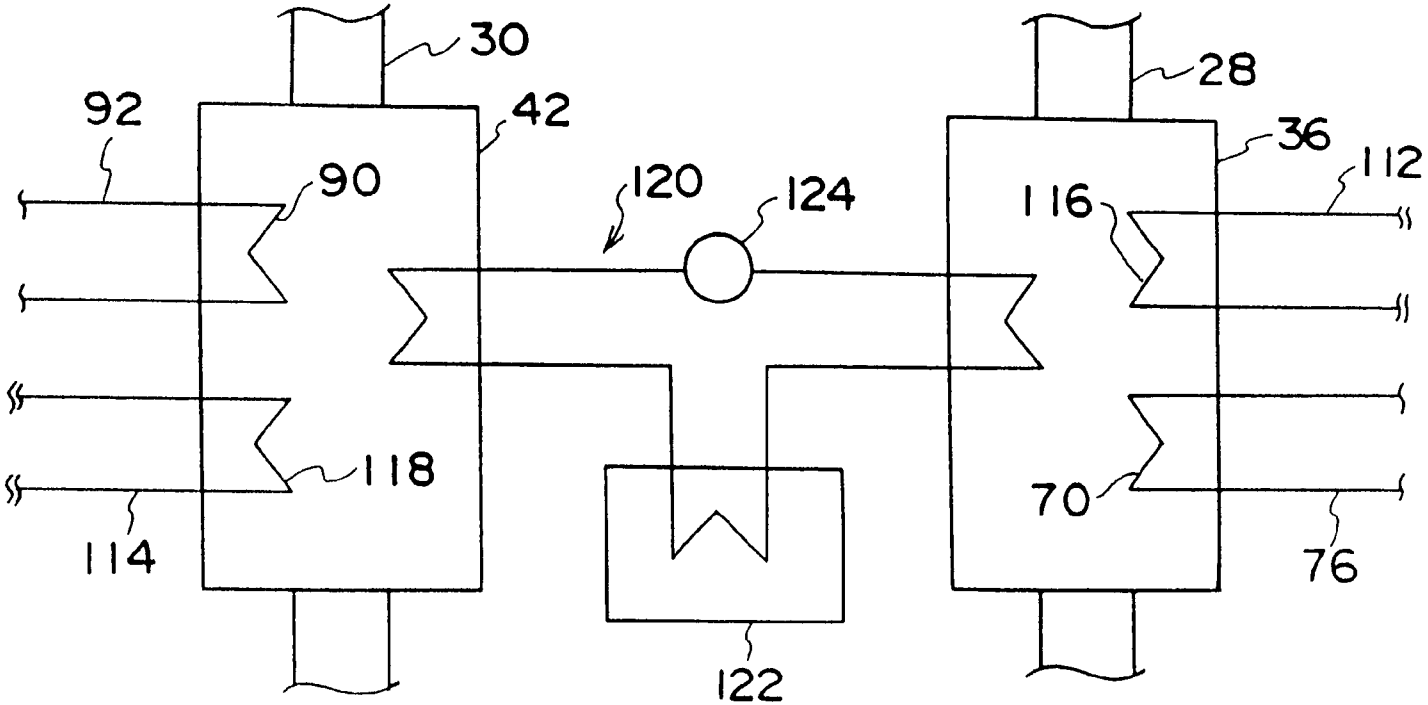
FIG. 3 is a diagram showing a general configuration of the hybrid air-conditioner of FIG. 1 further comprising a dedicated heat recovery circuit according to the present embodiment.

A dedicated heat recovery circuit 120 as shown in FIG. 3 may be added to the circuit configuration of the hybrid air-conditioner 10 described above.

First, the background of the additional use of the dedicated heat recovery circuit 120 will be explained. The heating medium or the like elements remaining in the pipes or the like as well as the first adsorption tank 36, the second adsorption tank 42 and the peripheral units (cases, pipes, etc.) thereof in batch operation repeatedly rise and fall in temperature, often leading to a heat loss for a reduced thermal efficiency of the air-conditioning system as a whole.

A solution to this problem employed in the prior art is to recover the heat held in the first adsorption tank 36 and the second adsorption tank 42 and use it for preheating and precooling (see JP-A No.5-296598, as an example) by switching the circuit connection and circulating the heating medium in the system for a predetermined length of time before switching the adsorption and regeneration processes between the first adsorption tank 36 and the second adsorption tank 42.

In this method, however, the heat held in the first adsorption tank 36 and the heat held in the second adsorption tank 42 are recovered by the circulating heating medium and mixed up. Thus, the system of the first adsorption tank 36 and the system of the second adsorption tank 42 are converged to a temperature intermediate of the two. For subsequently heating or cooling the adsorbent of the first adsorption tank 36 and the adsorbent of the second adsorption tank 42 to the required temperature, the heat amount required is one half that when no heat is recovered. Also, the use of the heating medium in the system makes the particular heating medium assume the intermediate temperature, with the result that a heat loss occurs to such an extent as to make the vapor adsorption cycle air-conditioner 14 impossible to reuse.

An effective method to overcome this problem is a configuration as shown in FIG. 3 in which the dedicated heat recovery circuit 120 with the heating medium dedicated to heat recovery pooled in the heating medium tank 122 is connected in series to the first adsorption tank 36 and the second adsorption tank 42.

Before heat recovery (i.e. before activating the dedicated heat recovery circuit 122 ), the heating medium is returned to the hot water storage tank 12 separately from the first heat exchanger 116 of the external heat source circuit 18 connected to the first adsorption tank 36 and the second heat exchanger 118 of the external heat source circuit 18 connected to the second adsorption tank 42. In this way, the heat loss of the heating medium of the external heat source can be prevented.

Next, the water pump 124 of the dedicated heat recovery circuit 120 is activated by the controller, so that the heating medium dedicated for heat recovery pooled in the heating medium tank 122 is circulated between the first adsorption tank 36 and the second adsorption tank 42. At the time when the temperature of the first adsorption tank 36 becomes as equal to the temperature of the second adsorption tank 42 as possible, the heating medium dedicated for heat recovery is returned into the heating medium tank 122.

In this way, the heat can be efficiently recovered from the first adsorption tank 36 and the second adsorption tank 42 while suppressing the heat loss of the heating medium. The heat thus recovered can be used for preheating or precooling of the first adsorption tank 36 and the second adsorption tank 42, thereby improving the thermal efficiency of the air-conditioning system as a whole.

According to the present embodiment, the temperature range for a cooling operation and the temperature range for a heating operation and supplying hot water are defined as described above. It should be understood, however, that the upper limit or the lower limit temperature of each temperature range is variable depending on the design specification of the piping and equipment used for the air-conditioning system and should be interpreted as a value having some margin.

It should also be understood that in place of the vapor adsorption cycle air-conditioner 14 used in the hybrid air-conditioner 10 according to the present embodiment, the vapor absorption cycle air-conditioner can be used.

As described above, an air-conditioning system according to a first aspect of the invention comprises a vapor adsorption cycle air-conditioner constituting an adsorption refrigerating cycle including an evaporator, a condenser and a plurality of adsorption tanks or a vapor absorption cycle air-conditioner constituting an absorption refrigerating cycle including an evaporator, a condenser, an absorber and a regenerator, a vapor compression refrigerating cycle air-conditioner connected to the adsorption tank of the vapor adsorption cycle air-conditioner or the absorber and the regenerator of the vapor absorption cycle air-conditioner for heating or cooling the adsorbent or the absorption solution as required, and an external heat source means connected to the adsorption tank of the vapor adsorption cycle air-conditioner or the absorber and the regenerator of the vapor absorption cycle air-conditioner for heating or cooling the adsorbent or the absorption solution using a heating medium supplied from an external heat source as required, wherein the vapor compression refrigerating cycle air-conditioner can assist in the temperature adjustment of the adsorbent, resulting in the great advantage that the temperature restrictions for activating the vapor adsorption cycle air-conditioner or the vapor absorption cycle air-conditioner can be removed thereby enlarging the operation allowance of the vapor adsorption cycle air-conditioner or the vapor absorption cycle air-conditioner, as the case may be.

In an air-conditioning system according to a second aspect of the present invention, which refers to the case of using a vapor adsorption cycle air-conditioner in the first aspect, the adsorption tank on adsorption side and the adsorption tank on regeneration side are connected to each other by a dedicated heat recovery circuit for recovering the heat by circulating a heating medium dedicated to heat recovery between the two air-conditioners. Therefore, the heat loss of the heating medium of the external heat source can be prevented. At the same time, the thermal efficiency can be improved by using the recovered heat for preheating and precooling.

In a method of controlling the operation of an air-conditioning system according to a third aspect of the present invention, the vapor adsorption cycle air-conditioner or the vapor absorption cycle air-conditioner alone is used for a cooling operation in the case where the external heat source temperature of the heating medium supplied from the external heat source means is in a predetermined high temperature range, only the vapor compression refrigerating cycle air-conditioner is used for the cooling operation in the case where the external heat source temperature of the heating medium supplied from the external heat source means is in a predetermined low temperature range, and both the vapor adsorption cycle air-conditioner and the vapor compression refrigerating cycle air-conditioner are used or both the vapor absorption cycle air-conditioner and the vapor compression refrigerating cycle air-conditioner are used for the cooling operation in the case where the external heat source temperature of the heating medium supplied from the external heat source means is in a predetermined intermediate temperature range. As in the first aspect of the present invention, therefore, the great advantage results that the temperature restriction for activating the vapor adsorption cycle air-conditioner or the vapor absorption cycle air-conditioner can be removed and the operation allowance of the vapor adsorption cycle air-conditioner or the vapor absorption cycle air-conditioner can be widened.

A method of controlling the operation of an air-conditioning system according to a fourth aspect of the present invention refers to the method of the third aspect, in which in the case where the external heat source temperature of the heating medium supplied from the external heat source means is in a predetermined intermediate temperature range, the high-temperature heating medium of the vapor compression refrigerating cycle air-conditioner is used for heating the adsorbent in the adsorption tank on the regeneration side or the absorption solution in the regenerator. Therefore, the great advantage results that the shortage of the external heat source temperature can be supplemented by the heat of the vapor compression refrigerating cycle air-conditioner. Consequently, a stable operation of the vapor adsorption cycle air-conditioner or the vapor absorption cycle air-conditioner can be secured while at the same time improving the thermal efficiency.

A method of controlling the operation of an air-conditioning system according to a fifth aspect of the present invention refers to the method of the third or fourth aspect of the present invention, in which for fast cooling operation, both the vapor adsorption cycle air-conditioner and the vapor compression refrigerating cycle air-conditioner are used at the same time or both the vapor absorption cycle air-conditioner and the vapor compression refrigerating cycle air-conditioner are used at the same time. As compared with when only one of the air-conditioners is used, the initial rate for cooling operation can be increased by a factor of two or more. As a result, the cooling efficiency can be remarkably improved while at the same time meeting the needs of the users.

A method of controlling the operation of an air-conditioning system according to a sixth aspect of the present invention refers to the air-conditioning system of the first or second aspect of the invention, in which for fast heating operation, both the vapor adsorption cycle air-conditioner and the vapor compression refrigerating cycle air-conditioner are used at the same time or both the vapor absorption cycle air-conditioner and the vapor compression refrigerating cycle air-conditioner are used at the same time. As compared with when only one of the air-conditioners is used, therefore, the initial rate for heating can be increased by a factor of two or more. As a result, the heating efficiency can be improved remarkably while at the same time meeting the needs of the users.

What is claimed is:

1. An air-conditioning system comprising:

a vapor adsorption cycle air-conditioner constituting an adsorption refrigerating cycle provided with an evaporator, a condenser and a plurality of adsorption tanks;

a vapor compression refrigerating cycle air-conditioner connected to the adsorption tank of the vapor adsorption cycle air-conditioner for heating or cooling the adsorbent as required; and external heat source means connected to the adsorption tank of the vapor adsorption cycle air-conditioner for heating or cooling the adsorbent using the heating medium supplied from the external heat source as required.

2. An air-conditioning system according to claim 1, wherein the adsorption tank on the adsorption side and the adsorption tank on the regeneration side are connected to each other by a dedicated heat recovery circuit for recovering heat by circulating a dedicated heat recovery heating medium between the two tanks.

3. A method of controlling the operation of an air-conditioning system comprising a vapor adsorption cycle air-conditioner constituting an adsorption refrigerating cycle provided with an evaporator, a condenser and a plurality of adsorption tanks, a vapor compression refrigerating cycle air-conditioner connected to the adsorption tank of the vapor adsorption cycle air-conditioner for heating or cooling the adsorbent as required, and external heat source means connected to the adsorption tank of the vapor adsorption cycle air-conditioner for heating or cooling the adsorbent using the heating medium supplied from the external heat source as required, comprising the steps of:

operating in cooling mode using only the vapor adsorption cycle air-conditioner or the vapor absorption cycle air-conditioner in the case where the external heat source temperature of the heating medium supplied from external heat source means is in a predetermined high temperature range;

operating in cooling mode using only the vapor compression refrigerating cycle air-conditioner in the case where the external heat source temperature of the heating medium supplied from the external heat source means is in a predetermined low temperature range; and operating in cooling mode using both the vapor adsorption cycle air-conditioner and the vapor compression refrigerating cycle air-conditioner at the same time in the case where the external heat source temperature of the heating medium supplied from the external heat source means is in a predetermined intermediate temperature range.

4. A method of controlling the operation of an air-conditioning system according to claim 3, wherein in the case where the external heat source temperature of the heating medium supplied from the external heat source means is in a predetermined intermediate temperature range, the high-temperature heating medium in the vapor compression refrigerating cycle air-conditioner is used for heating the adsorbent in the adsorption tank on the regeneration side or the absorption solution in the regenerator.

5. A method of controlling the operation of an air-conditioning system according to claim 3, wherein for fast cooling operation, both the vapor adsorption cycle air-conditioner and the vapor compression refrigerating cycle air-conditioner are used at the same time or both the vapor absorption cycle air-conditioner and the vapor compression refrigerating cycle air-conditioner are used at the same time.

6. A method of controlling the operation of an air-conditioning system according to claim 4, wherein for fast cooling operation, both the vapor adsorption cycle air-conditioner and the vapor compression refrigerating cycle air-conditioner are used at the same time or both the vapor absorption cycle air conditioner and the vapor compression refrigerating cycle air-conditioner are used at the same time.

7. A method of controlling the operation of an air-conditioning system comprising a vapor adsorption cycle air-conditioner constituting an adsorption refrigerating cycle provided with an evaporator, a condenser and a plurality of adsorption tanks, a vapor compression refrigerating cycle air-conditioner connected to the adsorption tank of the vapor adsorption cycle air-conditioner for heating or cooling the adsorbent solution as required, and an external heat source means connected to the adsorption tank of the vapor adsorption cycle air-conditioner for heating or cooling the adsorbent solution using a heating medium supplied from an external heat source as required, comprising the steps of:

operating in cooling mode using only the vapor adsorption cycle air-conditioner in the case where the external heat source temperature of the heating medium supplied from the external heat source means is in a predetermined high temperature range;

operating in cooling mode using only the vapor compression refrigerating cycle air-conditioner in the case where the external heat source temperature of the heating medium supplied from the external heat source means is in a predetermined low temperature range; and operating in cooling mode using both the vapor adsorption cycle air-conditioner and the vapor compression refrigerating cycle air-conditioner at the same time in the case where the external heat source temperature of the heating medium supplied from the external heat source means is in a predetermined intermediate temperature range, wherein in the case where the vapor adsorption cycle air-conditioner is used, the adsorption tank on adsorption side and the adsorption tank on regeneration side are connected to each other by a dedicated heat recovery circuit for recovering the heat by circulating a dedicated heat recovery heating medium between the two tanks.

8. A method of controlling the operation of an air-conditioning system according to claim 7, wherein in the case where the external heat source temperature of the heating medium supplied from the external heat source means is in a predetermined intermediate temperature range, the high-temperature heating medium of the vapor compression refrigerating cycle air-conditioner is used for heating the adsorbent in the adsorption tank on regeneration side.

9. A method of controlling the operation of an air-conditioning system according to claim 7, wherein for fast cooling operation, both the vapor adsorption cycle air-conditioner and the vapor compression refrigerating cycle air-conditioner are used at the same time.

10. A method of controlling the operation of an air-conditioning system according to claim 8, wherein for fast cooling operation, both the vapor adsorption cycle air-conditioner and the vapor compression refrigerating cycle air-conditioner are used at the same time.

11. A method of controlling the operation of an air-conditioning system comprising a vapor adsorption cycle air-conditioner constituting an adsorption refrigerating cycle provided with an evaporator, a condenser and a plurality of adsorption tanks, a vapor compression refrigerating cycle air-conditioner connected to the adsorption tank of the vapor adsorption cycle air-conditioner for heating or cooling the adsorbent solution as required, and an external heat source means connected to the adsorption tank of the vapor adsorption cycle air-conditioner for heating or cooling the adsorbent solution using a heating medium supplied from an external heat source as required;

wherein for fast heating operation, both the vapor adsorption cycle air-conditioner and the vapor compression refrigerating cycle air-conditioner are used at the same time.

12. A method of controlling the operation of an air-conditioning system comprising a vapor adsorption cycle air-conditioner constituting an adsorption refrigerating cycle provided with an evaporator, a condenser and a plurality of adsorption tank, a vapor compression refrigerating cycle air-conditioner connected to the adsorption tank of the vapor adsorption cycle air-conditioner and the regenerator of the vapor absorption cycle air-conditioner for heating or cooling the adsorbent solution as required, and an external heat source means connected to the adsorption tank of the vapor adsorption cycle air-conditioner for heating or cooling the adsorbent solution using a heating medium supplied from an external heat source as required;

wherein in the case where the vapor adsorption cycle air-conditioner is used, the adsorption tank on adsorption side and the adsorption tank on regeneration side are connected to each other by a dedicated heat recovery circuit for recovering heat by circulating a dedicated heat recovery heating medium between the two tanks; and wherein for fast heating operation, both the vapor adsorption cycle air-conditioner and the vapor compression refrigerating cycle air-conditioner are used at the same time.

* * * * *

UNITED STATES PATENT AND TRADEMARK OFFICE

CERTIFICATE OF CORRECTION

PATENT NO. : 6,314,744 B1
DATED : November 13, 2001
INVENTOR(S) : Masahiro Ogawa It is certified that error appears in the above-identified patent and that said Letters Patent is hereby corrected as shown below:

Title page,
Item [56], please add the following:

-- OTHER PUBLICATIONS
H. YANAGI, et al. "PROTOTYPE TEST OF ADSORPTION REFRIGERATOR USING SILICAGEL-WATER PAIRS", I.I.F - I.I.R. - Commission B1, Paris, France, 1992, pgs. 117-122 --

Signed and Sealed this

Eleventh Day of February, 2003

JAMES E. ROGAN
*Director of the United States Patent and Trademark Office*